US010384700B2

(12) United States Patent
Ruskauff et al.

(10) Patent No.: US 10,384,700 B2
(45) Date of Patent: Aug. 20, 2019

(54) METHOD OF INDICATING A RAILWAY SWITCH STATUS

(71) Applicant: Vossloh Signaling USA, Inc., Charlotte, NC (US)

(72) Inventors: David Ruskauff, Thornton, TX (US); Donald Coy Beaman, Thornton, TX (US)

(73) Assignee: Vossloh Signaling USA, Inc., Charlotte, NC (US)

( * ) Notice: Subject to any disclaimer, the term of this patent is extended or adjusted under 35 U.S.C. 154(b) by 210 days.

(21) Appl. No.: 15/430,580

(22) Filed: Feb. 13, 2017

(65) Prior Publication Data

US 2017/0151968 A1 Jun. 1, 2017

Related U.S. Application Data

(63) Continuation of application No. 14/514,327, filed on Oct. 14, 2014, now Pat. No. 9,586,603, which is a continuation of application No. 12/291,465, filed on Nov. 10, 2008, now Pat. No. 8,857,770, which is a continuation-in-part of application No. 12/217,184, filed on Jul. 2, 2008, now abandoned, which is a continuation of application No. 11/028,753, filed on Jan. 3, 2005, now Pat. No. 7,416,159.

(60) Provisional application No. 61/002,725, filed on Nov. 9, 2007, provisional application No. 60/534,088, filed on Jan. 2, 2004.

(51) Int. Cl.

| | |
|---|---|
| ***B61L 25/06*** | (2006.01) |
| ***B61L 7/00*** | (2006.01) |
| ***B61L 7/06*** | (2006.01) |
| ***B61L 7/08*** | (2006.01) |
| ***B61L 25/02*** | (2006.01) |

(52) U.S. Cl.

CPC ..... *B61L 25/065* (2013.01); *B61L 7/00* (2013.01); *B61L 7/06* (2013.01); *B61L 7/065* (2013.01); *B61L 7/08* (2013.01); *B61L 25/025* (2013.01)

(58) Field of Classification Search

CPC .... B61L 7/065; B61L 5/00; B61L 5/06; B61L 5/062; B61L 7/00; B61L 7/06; B61L 7/08; B61L 11/00; B61L 11/08; B61L 13/00; B61L 13/002; B61L 13/04; B61L 2011/00; B61L 2011/08; B61L 5/107; B61L 25/025; B61L 17/00; B61L 25/04; B61L 1/18; B61L 1/181; B61L 23/007; B61L 23/042; B61L 19/06; B61L 27/04; B61L 21/04; B61L 3/221; B61L 25/065; B61L 25/06

USPC .... 701/19, 20; 246/219, 220, 253, 162, 176, 246/476, 124, 122 R

See application file for complete search history.

(56) References Cited

U.S. PATENT DOCUMENTS 838,542 A * 12/1906 Hitch ..... B61L 25/065 200/86 R
2,207,108 A * 7/1940 Pelikan ..... B61L 19/06 246/160

(Continued)

*Primary Examiner* — Mark T Le
(74) *Attorney, Agent, or Firm* — Michael G. Monyok

(57) ABSTRACT

A method for indicating a status of a railroad switch is configured for use in un-signaled (dark) territory utilizing vital audio messages. In one embodiment, the method comprises receiving a DTMF signal from a railway vehicle, initializing control of the switch, and triggering the reporting of a correspondence condition through vital relays or other electronic components.

7 Claims, 4 Drawing Sheets

(56) References Cited

U.S. PATENT DOCUMENTS

| | | | | | |
|---|---|---|---|---|---|
| 3,952,977 | A * | 4/1976 | Vermeulen | B61L 1/187 | 246/37 |
| 3,963,203 | A * | 6/1976 | Pascoe | B61L 13/002 | 246/134 |
| 4,392,626 | A * | 7/1983 | Pascoe | B61L 1/20 | 246/122 R |
| 4,711,418 | A * | 12/1987 | Aver, Jr. | B61L 27/04 | 246/187 B |
| 5,050,823 | A * | 9/1991 | Parker | B61L 7/06 | 246/219 |
| 7,416,159 | B2 * | 8/2008 | Beaman | B61L 5/067 | 246/219 |

* cited by examiner

RADIO
D10
D12
T
B
ASR
RWP
NWP
D15
D13
Trigger
Audio 1
Audio Out
PTT
B12
N12
• NORMAL
(Locked)
Audio 2
• REVERSE
(Locked)
Audio 3
• NOT LINED
Audio 4
CONTROL RECEIVED
Audio 5
AUTO RESTORE
PLC-07
PLC-08
PLC-09
PLC-010
PLC-011

METHOD OF INDICATING A RAILWAY SWITCH STATUS

CROSS REFERENCE TO RELATED APPLICATIONS

This application is a continuation of U.S. patent application Ser. No. 14/514,327, filed on Oct. 14, 2014, entitled RAILWAY DARK TERRITORY SWITCH AUTOMATION; which is a Continuation of U.S. patent application Ser. No. 12/291,465, filed on Nov. 10, 2008 (now U.S. Pat. No. 8,857,770); which is a Continuation-in-Part of U.S. patent application Ser. No. 12/217,184 filed on Jul. 2, 2008; which is a Continuation of U.S. patent application Ser. No. 11/028,753, filed on Jan. 3, 2005 (now U.S. Pat. No. 7,416,159); which claims priority to U.S. Provisional Patent Application No. 60/534,088, filed on Jan. 2, 2004, all having common inventor Ruskauff. This Application is further related to U.S. Provisional Patent Application No. 61/002,725 filed Nov. 9, 2007, also to Ruskauff.

STATEMENT REGARDING FEDERALLY SPONSORED RESEARCH

Not applicable.

BACKGROUND OF THE INVENTION

The present invention relates generally to railroad infrastructure, and more particularly to railroad switches in un-signaled (dark) territory.

The United States rail system is currently comprised of approximately 143,000 track miles, of which, approximately only 70,000 miles are currently signaled. Signal systems are generally comprised of wayside signals, power operated switches, vital track circuits, and "vital" field logic implemented in either relay-based systems, or solid state devices (note that the use of the term "vital" in this application is associated in the industry with known performance and reliability parameters, and does not mean "vital" in a patentability sense, or patent-interpretation sense, unless otherwise explicitly stated herein). The signal systems provide for the safe control and movement of railway vehicles through the operation of the signals and switches. This control is predominantly accomplished through the use of Centralized Traffic Control (CTC) systems where a dispatcher remotely controls the signals and switches. Signal systems, CTC systems, and their components, are well known and understood in the current art. Such systems are not applied universally due to the high costs of acquisition and maintenance.

The remaining 70,000 miles of track are considered to be "dark" territory. Movement of railway vehicles in dark territory is governed by verbal communication and authorization, issued by a dispatcher, thereby maintaining the safe separation and movement of the railway vehicles. These verbal communications can be automated, however, automated systems comprise multiple points of potential failure. It would therefore be advantageous to reduce the points of potential failure for a dark-territory automated railroad track circuit.

BRIEF SUMMARY

According to embodiments of the present invention is a method of indicating the status of a railroad switch in dark territory. In one example embodiment, a signal requesting a switch position is received from a railway vehicle. In turn, based on a current position of the switch and a location of the railway vehicle, a message is transmitted to the railway vehicle from one of a plurality of audio boards.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which.

DETAILED DESCRIPTION

Figure 1:
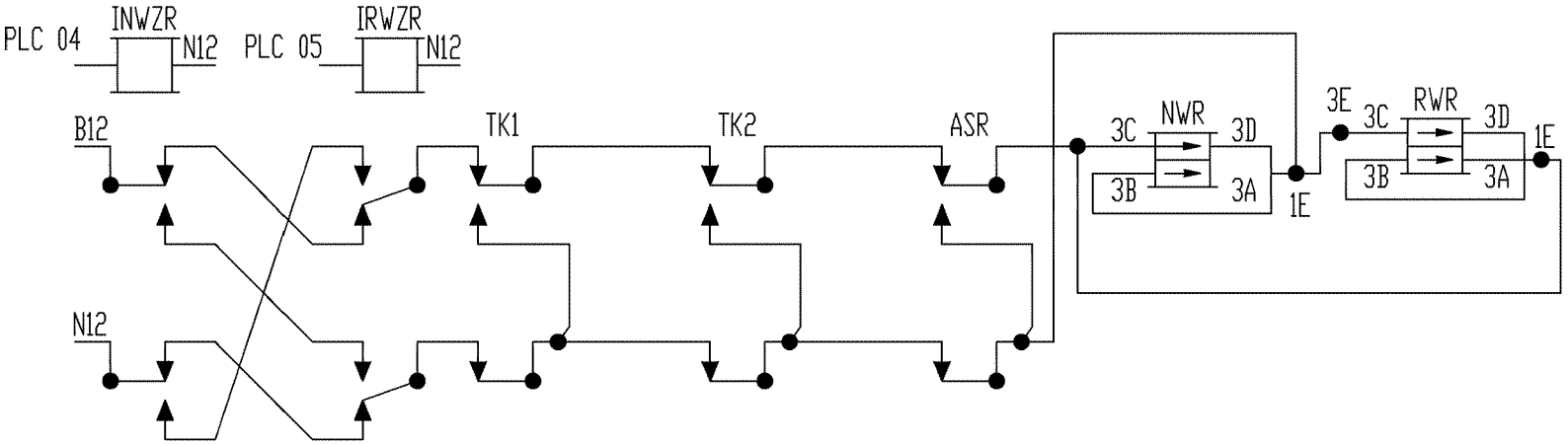
FIG. 1 is a block schematic of one embodiment of the invention's relays.

As will be understood by those of ordinary skill in the art, various structures and devices are depicted in block diagram form in order to avoid unnecessarily obscuring the invention. As used, herein and the accompanying drawings, B12 refers to positive 12 volts, and N12 refers to negative 12 volts. Additionally the term "set" refers to the application of 12 volts (B12), while the term "reset" refers to the removal of 12 volts.

Some methods of the invention may be practiced by placing the invention on a computer-readable medium. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to transport the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

The present invention provides remote switch control utilizing Dual Tone Multiple Frequency (DTMF) control. Indications to a train (or, more properly, its crewmembers) are provided by single aspect, three color, switch point position indicators and pre-recorded audible messages transmitted via VHF/UHF radios. Preferably, the invention is "fully vital" (meaning sufficiently reliable to be called "vital" as the term is defined in the industry). From a functional point of view, the invention provides: switch locking based on time or occupancy, switch point position indicators, and audible messages for lined and locked normal and reverse positions.

A device located concurrent with a section of one of said tracks located dark territory, wherein the device is configured with the following functions:

receiving a wireless dual tone multiple frequency (DTMF) signal sent from a first communications device, and wherein the wireless DTMF signal is generated from a railway vehicle and indicates a desired railroad switch position for a railroad switch, validating the wireless DTMF signal, initiating a control of the railroad switch, checking a relay to determine a relay status, wherein the relay is coupled to the railroad switch, and wherein the railroad switch does not have a switch signal system that in associated with a central dispatch system, determining in a correspondence condition, triggering an audio board to report the correspondence condition via an audio message, which is maintained on a discrete audio board, and an output of the audio board is checked by a relay, reporting the correspondence condition, and reporting, from a wirelessly controlled switch, a status of the railroad switch in a dark territory.

The device further comprises a plurality of relay contacts coupled to relays, and wherein the device is configured to calculate a system state and to trigger an output that triggers an audio output of the audio board to route through the plurality of relay contacts, and the audio board is configured to vitally report a correspondence condition as normal, reverse, or loss of correspondence.

The exemplary embodiment may comprise these components/nomenclature:

1. Power Operated Switch: M23, 5H, or Power Operated Hydraulic Spring Switch
2. VHF/UHF Radio
3. DTMF Decoder
4. Individual Environmentally Resilient Radio Boards, one message per board
   Audio 1: Locked Normal Message
   Audio 2: Locked Reverse Message
   Audio 3: Not Lined Message
   Audio 4: Not Lined Message
   Audio 5: Restored to Normal Message
5. PLC: Controls Switch, Triggers Audio Messages, Starts Timer
6. Track Circuits (typically four (4) wire)
   OS1: Main Track over switch points
   OS2: Diverging/Siding Track
7. Timers
   15 Minute Approach
   10 Second Loss of Shunt (LOS) for Main Track
8. Relays
   NWP or NWR (Normal Switch Position Repeater): Driven by switch machine or power operated switch (M23, 5H), switch circuit controller or shelf point detection system on power operated spring switch.
   RWP or RWR (Reverse Switch Position Repeater): Driven by switch machine or power operated switch (M23, 5 H), switch circuit controller or shelf point detection system on power operated spring switch.
   ASR (Approach Stick Relay): Used to lock switch machine while Approach Timer is running.
   TK1: Repeats OS1 with LOS. Locks Switch Machine.
   TK2: Repeats OS2. Locks Switch Machine.
   NWZ: Normal Switch Control
   RWZ: Reverse Switch Control Switch locking is provided by three relays shown in FIG. 1, which is a block schematic of one embodiment of the invention's relays. A first relay TK1 and a second relay TK2 repeat the first track circuit OS1 and the second track circuit OS2 as described in the above-referenced and incorporated patent application. With either or both relays "down", the switch cannot be controlled. In addition, the third relay ASR will lock the switch machine and is driven by the Approach Timer shown in FIG. 2.

Figure 2:
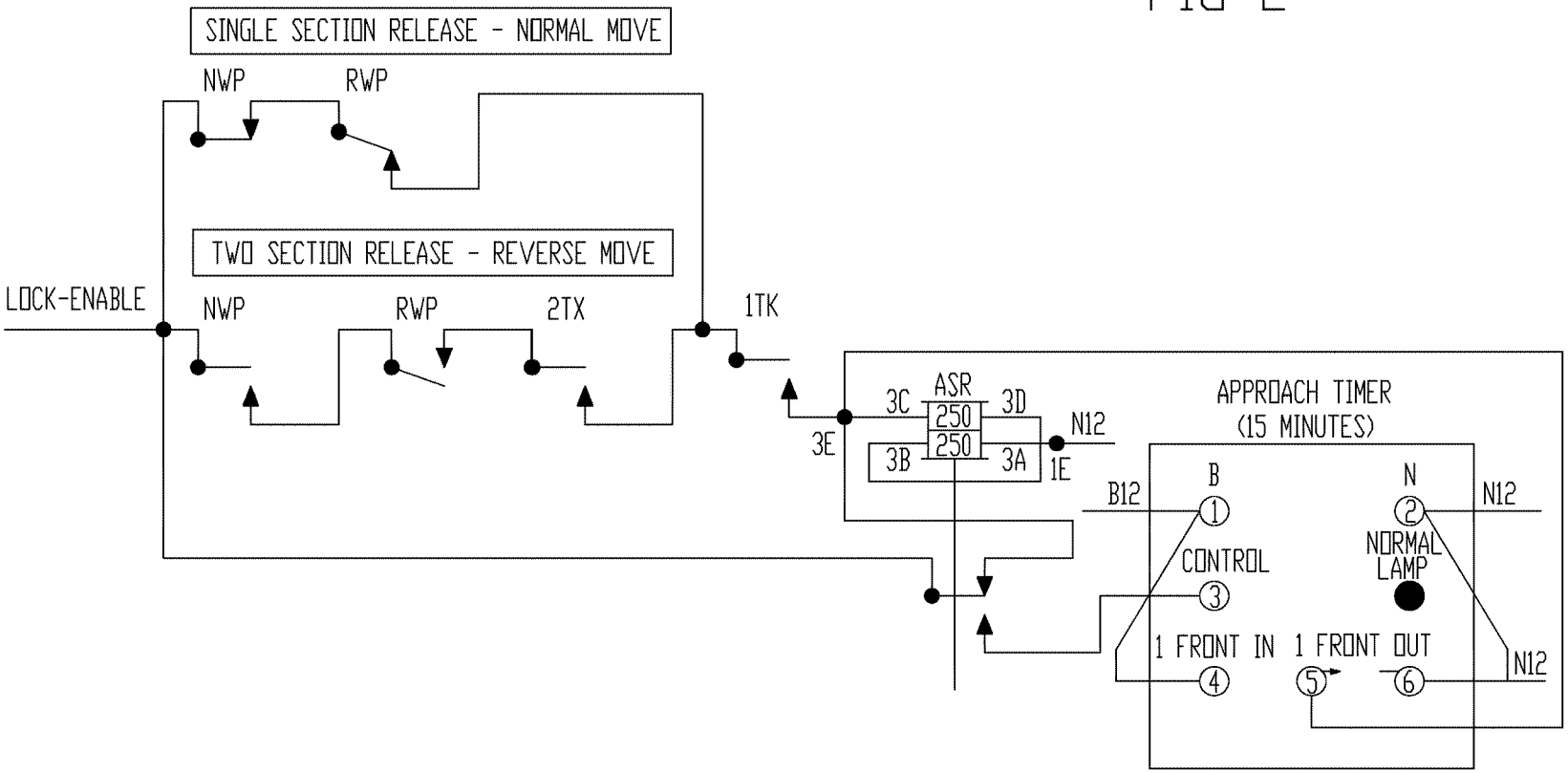
FIG. 2 is a block schematic of one embodiment of the approach timer circuit.

FIG. 2 is a block schematic of one embodiment of the approach timer circuit. The invention time locks the switch machine by the use of the third relay ASR. The third relay ASR is normally held "up" by its own contacts and is driven by the "LOCK ENABLE" output from the PLC (Programmable Logic Controller). Once the switch machine is in correspondence, the PLC momentarily drops the LOCK-ENABLE output which forces the third relay ASR to drop, which provides a path to the Approach Timer. The third relay ASR recovers via: 1) the expiration of the fifteen-minute Approach Timer, or 2) the first relay TK1 dropping on a normal move (single section release), or 3) the first relay TK1 and the second relay TK2 dropping on a reverse move (two section release). With the switch occupied, the ASR will recover, but the switch will continue to remain locked by the first relay TK1 and/or the second relay TK2.

Figure 3:
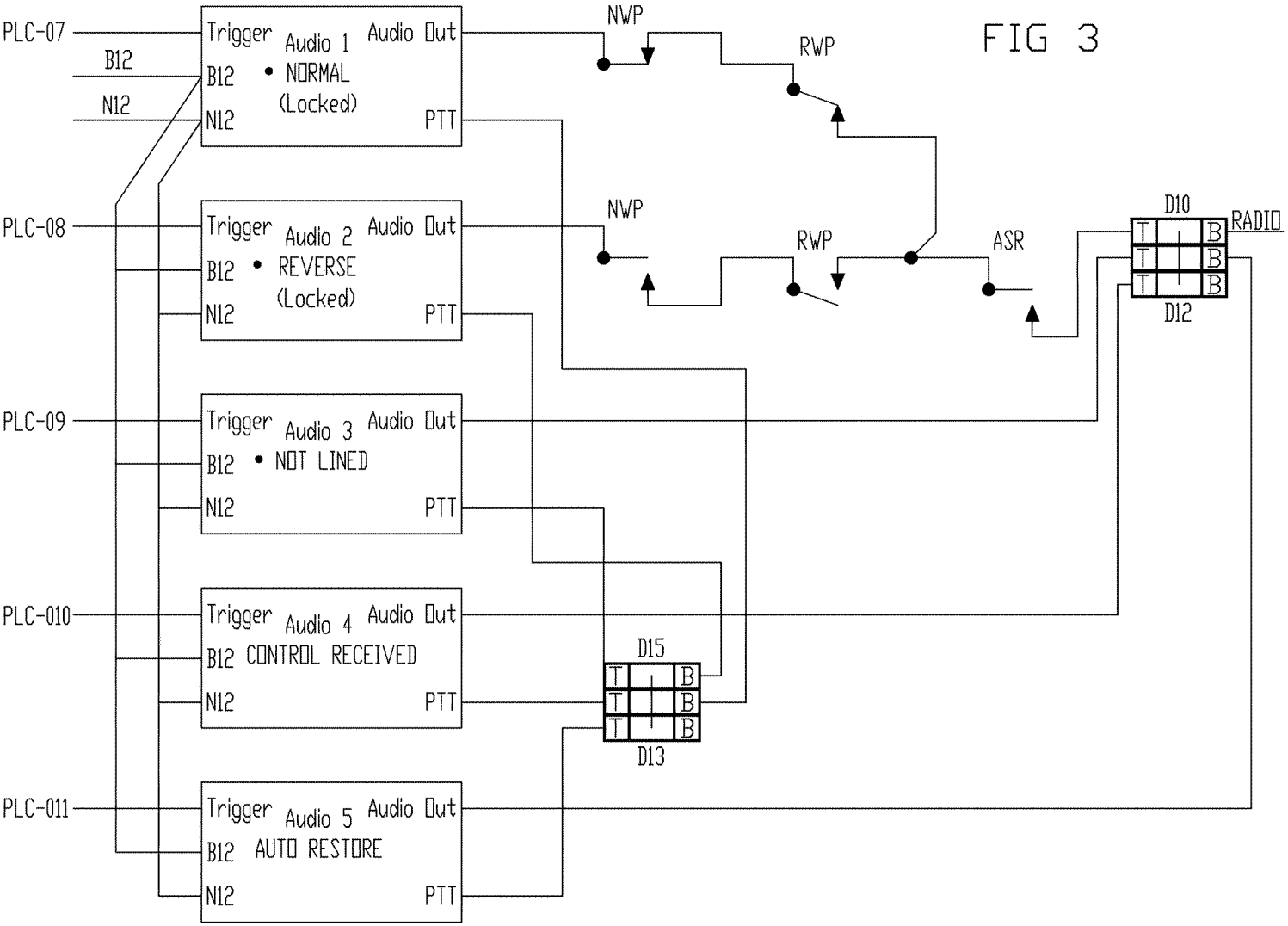
FIG. 3 is a block schematic of one embodiment of the audio message system.

The invention provides audio messages with vital reliability by use of discrete audio boards for the recording and playback of individual messages. Each audio board contains only one message, and is equipped with a trigger, audio output and push to talk output. Each audio board is also environmentally resilient, meaning that each board will operate in temperatures of greater than 120-degrees Fahrenheit, and less than zero-degrees Fahrenheit, and can operate in other recognized environmental extremes. The messages are triggered by the PLC. Routing the audio output of each board through the NWP, RWP and third relay ASR provide the vital audio functions as shown in FIG. 3, which is a block schematic of one embodiment of the audio message system.

For the Audio 1 message to be transmitted, the NWP must be up, the RWP must be down, and the third relay ASR must be down. This occurs only if the switch is in the normal position and the time is locked. For the Audio 2 message to be transmitted, the NWP must be down, the RWP must be up, and the third relay ASR must be down. This occurs if the switch is in the reverse position and the time is locked. The Audio 3 message, Audio 4 message, and Audio 5 messages can be transmitted at any time.

Accordingly, on a controlled normal move, the only valid message is the Audio 1 message. Any other message will require the train to approach prepared to stop. On a controlled reverse move, the only valid message is the Audio 2 message. All other messages require the train to approach prepared to stop.

Figure 4:
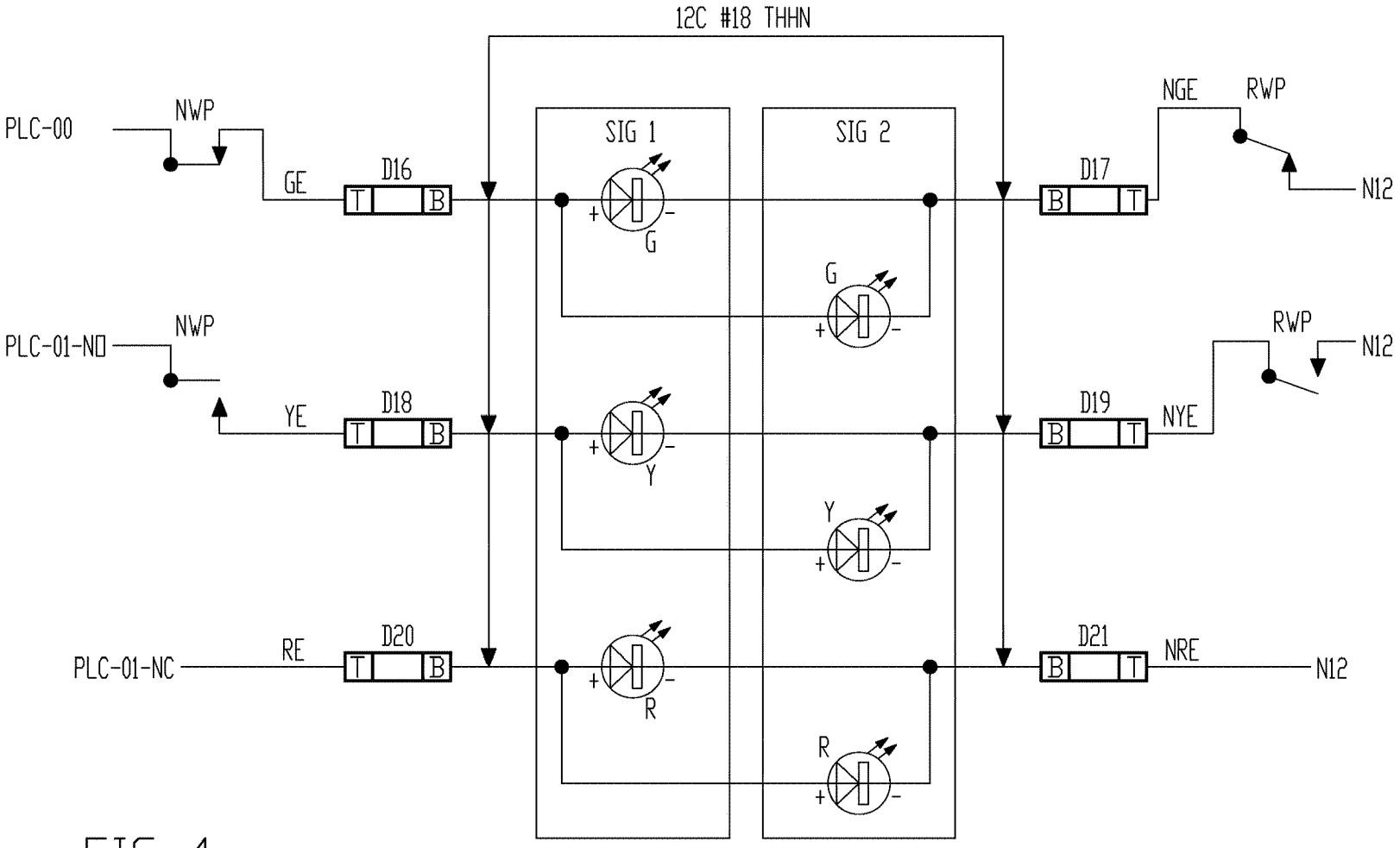
FIG. 4 is a block schematic of one embodiment of the vital switch point indicator system.

FIG. 4 is a block schematic of one embodiment of the vital switch point indicator system. The invention provides switch point position indicators by routing the PLC outputs for green (normal), and yellow (reverse) through the NWP and RWP relays. Thus, preferably, each of the indicators, the audio messages, and the switch locking are all "vital" rated.

In operation, trains approaching an invention-equipped switch to be prepared to stop, unless the switch has been controlled and the correct indication (audio message and/or indicator) has been received. Thus, trains are required to control the location before all movements are made. Although distance from which the location must be controlled vary, the distance is typically two miles and is also typically identified with a passive control sign.

Once the location is controlled and in correspondence, the switch is time locked for fifteen (15) minutes. The location cannot be re-controlled until the time expires or is slotted off by the occupancy of the track circuits. Additionally, once the machine is locked, the correct message (Audio 1 or Audio 2) is transmitted and the appropriate indicators are displayed. By operating rule, the failure to receive a correct message including not receiving any message, requires trains to approach the location prepared to stop. If the switch machine fails to achieve correspondence, the Audio 3 message is transmitted, informing the crew that the switch is not lined correctly. Audio 4 is transmitted when using "slow speed switch machines" to inform the crew that the control information has been received and that the switch is moving.

The invention continuously monitors the switch position once the switch has been time locked. Any loss of correspondence triggers the Audio 3 message. This message may optionally be repeated at regular intervals until the switch has been returned to correspondence. This provides continuous advance warning if the switch is tampered with after it has been controlled.

The invention also provides an optional Auto Restore. This feature will automatically return the switch to the normal position after a reverse move. Once the switch has been returned the system broadcasts the Audio 5 message (the switch restored message). The switch is not time locked after a restore and is available immediately for re-control.

Of course, it should be understood that the order of the acts of the algorithms discussed herein may be accomplished in different order depending on the preferences of those skilled in the art, and such acts may be accomplished as software, and that equivalent methods (and portions of methods) having equivalent or substantially similar ends may be substituted, and are readily apparent to those of ordinary skill in the art after reading this disclosure. Furthermore, though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

What is claimed is:

1. A method of indicating a status of a railroad switch in dark territory comprising:

receiving a signal from a railway vehicle, wherein the signal indicates a desired position for the railroad switch;

identifying an occupancy status of the railway vehicle, wherein the occupancy status identifies whether the railway vehicle is present in a portion of track through the use of a track detection circuit comprising the portion of the track, identifying a current position of the switch;

generating a message on at least one audio board of a plurality of discrete audio boards, wherein each audio board of the plurality of discrete audio boards contains a unique message; and transmitting the message from only one audio board of the plurality of audio boards to the railway vehicle, wherein the transmitting audio board is capable of transmitting based on the occupancy status of the railway vehicle and the position of the switch.

2. The method of claim 1, wherein transmitting the message from only one audio board of the plurality of audio boards to the railway vehicle further comprises:

electrically disconnecting at least one audio board from the plurality of discrete audio boards from a transmitter.

3. The method of claim 1, further comprising:

determining the status of a lockout timer triggered by an entrance of a railway vehicle into the portion of the track, wherein the transmitting audio board is further selected based on the status of the lockout timer.

4. The method of claim 1, wherein transmitting the message from only one audio board of the plurality of audio boards to the railway vehicle is done vitally.

5. The method of claim 2, further comprising:

electrically disconnecting at least one audio board from the plurality of discrete audio boards from a transmitter through the use of a plurality of relays, wherein at least one relay of the plurality of relays is connected to the track detection circuit.

6. The method of claim 2, further comprising:

electrically disconnecting at least only one audio board from the plurality of discrete audio boards from a transmitter through the use of a digital controller, wherein the digital controller is connected to the track detection circuit and the switch.

7. The method of claim 1, wherein the message comprises at least one of an indication of the position of the switch and an indication of a movement of the switch.

* * * * *